US007513784B2

(12) United States Patent
Shibata

(10) Patent No.: US 7,513,784 B2
(45) Date of Patent: Apr. 7, 2009

(54) LEVER-TYPE CONNECTOR AND CONNECTOR ASSEMBLY

(75) Inventor: Takahiro Shibata, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/098,651

(22) Filed: Apr. 7, 2008

(65) Prior Publication Data

US 2008/0248664 A1 Oct. 9, 2008

(30) Foreign Application Priority Data

Apr. 9, 2007 (JP) ..... 2007-101247

(51) Int. Cl.
*H01R 13/62* (2006.01)

(52) U.S. Cl. ..... 439/157

(58) Field of Classification Search ..... 439/157, 439/160, 310, 372, 140
See application file for complete search history.

(56) References Cited

U.S. PATENT DOCUMENTS 6,146,161 A 11/2000 Osawa
6,193,531 B1 2/2001 Ito et al.
6,488,516 B2 * 12/2002 Osawa et al. ..... 439/157
6,623,285 B2 * 9/2003 Nishide ..... 439/140
2003/0109167 A1 6/2003 Maegawa

FOREIGN PATENT DOCUMENTS

EP 1 024 560 A2 8/2000
JP 11-067338 3/1999

* cited by examiner

*Primary Examiner*—Edwin A. Leon
(74) *Attorney, Agent, or Firm*—Gerald E. Hespos; Anthony J. Casella

(57) ABSTRACT

A lever (60) of a connector can be rotated towards a connection side, and a moving plate (80) is pressed by cam pins (35) of the female connector housing (30) to reach an advanced position. As the lever (60) is rotated toward a separation side, first and second engaging portions (88), (89) are directly or indirectly engaged with separation cam surfaces (64D) of the cam grooves (64) to move the moving plate (80) to a retracted position. The moving plate (80) is not engaged with connection cam surfaces (64C) of the cam grooves (64), and the first and second engaging portions (88, 89) are provided at the outer edges of the openings of fitting recesses (85) of the moving plate (80) deviated from sides corresponding to the connection cam surfaces (64C) of the cam grooves (64).

13 Claims, 10 Drawing Sheets

LEVER-TYPE CONNECTOR AND CONNECTOR ASSEMBLY

BACKGROUND OF THE INVENTION

1. Field of the Invention

The invention relates to a lever-type connector and to a corresponding connector assembly.

2. Description of the Related Art

Japanese Unexamined Patent Publication No. H11-67338 discloses a lever-type connector assembly with male and female housings that are connectable with and separable from each other. The male housing includes a receptacle and tabs of male terminal fittings project into the receptacle. A lever is supported rotatably on the outer surfaces of the receptacle. The lever has cam grooves, and the female connector housing has cam pins that are engageable with the cam grooves. A moving plate is mounted in the receptacle and is movable back and forth between a retracted position at an opening side of the receptacle and an advanced position at a back side of the receptacle while the tabs of the male terminal fittings are passed therethrough.

The moving plate includes fitting recesses, into which the cam pins are insertable. U-shaped fitting tubes each project at the opposite sides of the outer edge of the opening of each fitting recess. Each fitting tube is comprised of a pair of projecting pieces and an end plate. The fitting tubes are entirely insertable into the cam grooves, and receiving grooves are formed in the fitting tube portions for receiving the cam pins.

The lever can be rotated towards a connection side while the cam pins are engaged with the cam grooves and the fitting tubes. Thus, the cam pins or fitting tubes slide in contact with connection cam surfaces of the cam grooves to connect the housings. Additionally, the cam pins press inner surfaces of the fitting recesses and side surfaces of the receiving grooves to move the moving plate to the advanced position. The lever also can be rotated towards a separation side while the cam pins are engaged with the cam grooves and the fitting tubes. Thus, the cam pins or fitting tubes are pressed against and slide in contact with separation cam surfaces of the cam grooves to separate the housings, and the cam pins press the side surfaces of the receiving grooves to move the moving plate to the retracted position.

In the above case, the cam pins enter the receiving grooves of the fitting tubes to form cylindrical cam followers. However, since the projecting pieces of the fitting tubes project at the opposite sides of the cam pins, the cam pins become relatively narrower and less strong.

The cam pins can be strengthened by eliminating the fitting tubes. However, the moving plate cannot follow the cam pins as the lever is rotated towards the separation side if the fitting tubes are eliminated completely. Hence, the moving plate will not return to the retracted position.

The invention was developed in view of the above and an object is to provide a lever-type connector that avoids reducing the strength of a cam pin and moving a moving plate according to the rotation of a lever.

SUMMARY OF THE INVENTION

The invention relates to a connector with a housing that includes a receptacle for receiving a mating housing of a mating connector. A movable member, such as a lever, is mounted displaceably on the housing and includes at least one cam groove for receiving a cam pin of the mating housing. A moving plate is mounted to the housing and is movable back and forth between a retracted position where the moving plate is near an opening end of the receptacle and an advanced position where the moving plate is near a back end of the receptacle. Terminal fittings are mounted in the housing and pass through the moving plate as the moving plate is moved between the advanced position and the retracted position. The moving plate includes at least one fitting recess for receiving the cam pin of the mating housing. The cam groove has a connection cam surface that slidably engages the cam pin as the lever is displaced towards a connection side for urging the housing and the mating housing towards one another. The mating housing presses the moving plate and moves the moving plate to the advanced position as the housing and the mating housing move towards one another. The cam groove further has a separation cam surface that slidably engages the cam pin as the lever is displaced towards a separation side for urging the housing and the mating housing away from one another. The moving plate includes at least one first engaging portion to be engaged directly with the separation cam surface of the cam groove or at least one second engaging portion to be engaged indirectly with the separation cam surface of the cam groove via the cam pin. Thus, the moving plate can reach the retracted position as the lever is displaced towards the separation side.

The first and/or second engaging portions preferably are at positions of the outer edge of the opening of the fitting recess of the moving plate deviated from a side corresponding to the connection cam surface of the cam groove. Additionally, the moving plate preferably does not engage the connection cam surface of the cam groove. Thus, the cam pin itself can have e.g. a cylindrical shape, a larger diameter and greater strength. Further, only the cam pin is engageable with the connection cam surface of the cam groove, and the stability of the cam operation can be guaranteed during the displacement of the lever towards the connection side.

The moving plate preferably includes the second engaging portion, and the second engaging portion preferably projects into the fitting recess from the inner edge of the opening of the fitting recess and can contact the cam pin in a separating direction of the mating housing as the lever is displaced towards the separation side. Thus, the moving plate can be brought to the retracted position by the engagement of the second engaging portion with the cam pin.

The moving plate preferably includes the first engaging portion, and the first engaging portion preferably projects into the cam groove from a side of the outer edge of the opening of the fitting recess substantially corresponding to the separation cam surface of the cam groove. The first engaging portion can be pressed against and brought into sliding contact with the separation cam surface of the cam groove as the lever is displaced towards the separation side. Thus, the moving plate can be brought to the retracted position by the direct engagement of the first engaging portion with the separation cam surface of the cam groove.

The provision of both the first and second engaging portions enables the first engaging portions to compensate for a problem that might occur with the second engaging portion. Therefore, the moving plate can be brought reliably to the retracted position.

The moving plate preferably includes the first engaging portion, and the lever is formed with an engaging recess for receiving the first engaging portion when the moving plate is at or near the retracted position. The engagement of the first engaging portion in the engaging recess restricts movement of the moving plate. However, the first engaging portion comes out of the engaging recess as the lever is displaced toward the connection side so that the moving plate can be moved towards the advanced position. Accordingly, there is no need to provide a special positioning portion for keeping the moving plate at the retracted position in addition to the first engaging portion. Therefore the construction can be simplified.

The moving plate preferably has one or more guiding ribs to fit into one or more respective guidable grooves in the receptacle for guiding movements of the moving plate.

The lever preferably has at least one partial locking piece to be engaged resiliently with the receptacle when the lever is at the separation side and/or with at least one full locking piece to be resiliently engaged with at least one locking rib at the receptacle. Thus, the lever can be positioned at the connection position. The locking rib preferably is engaged with at least one locking groove of the lever for guiding the movement of the lever.

The invention also relates to a lever-type connector assembly comprising the above-described lever-type connector and a mating connector connectable therewith.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector in accordance with the invention is illustrated in FIGS. 1 to 10 and includes male and female housings 10, 30 that are connectable with and separable from each other. Ends of the housings 10, 30 to be connected are referred to herein as the front ends.

Figure 7:
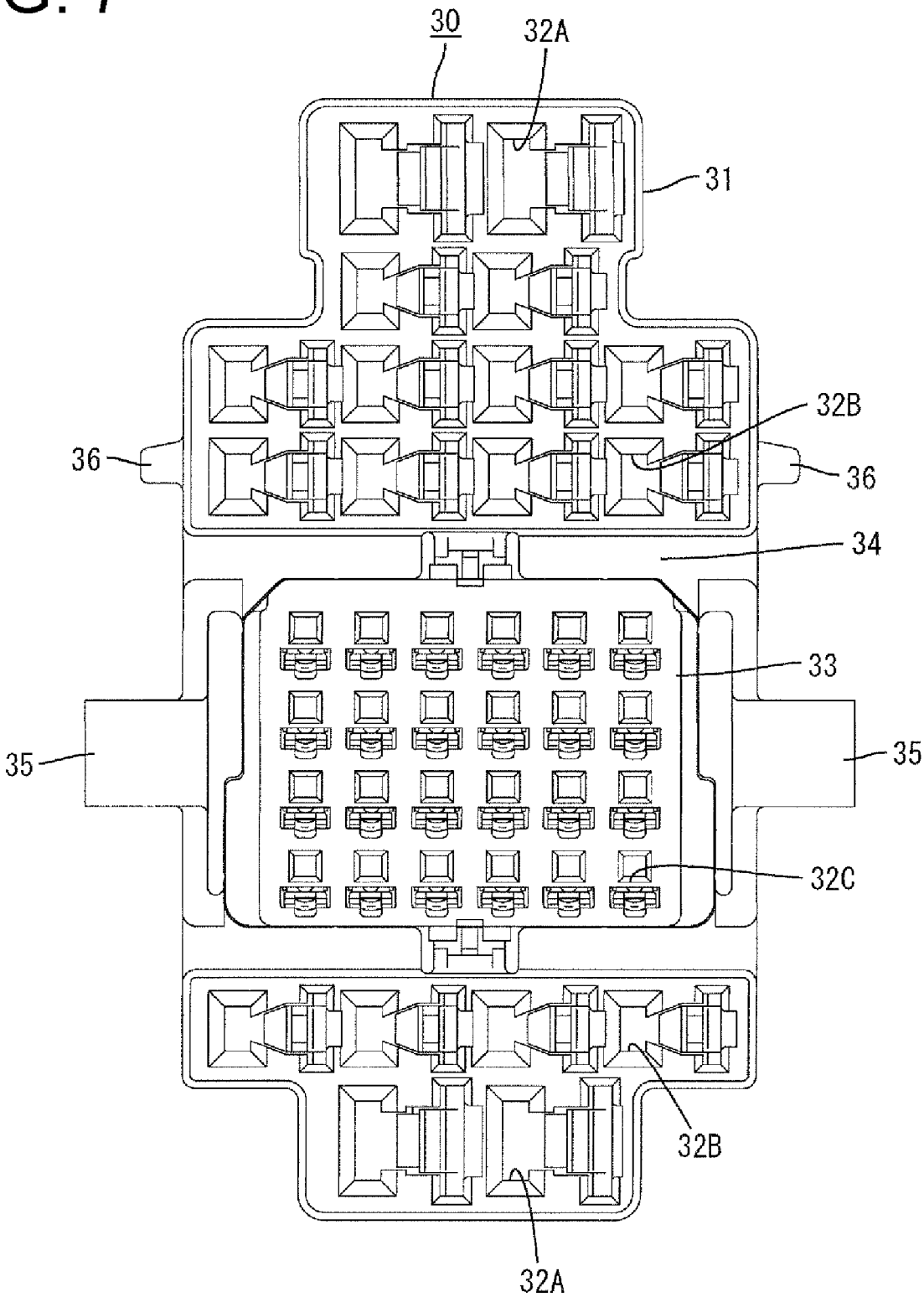
FIG. 7 is a front view of the female connector housing.

As shown in FIG. 7, the female housing 30 includes a main body 31 substantially in the form of a vertically long block. The main body 31 includes first, second and third kinds of cavities 32A, 32B and 32C having different sizes and configurations. Female terminal fittings (not shown) can be inserted into the respective cavities 32A, 32B and 32C from behind. The first cavities 32A are at opposite upper and lower ends and are configured to receive large female terminal fittings. The third cavities 32C are slightly below a vertical center and are configured to receive small female terminal fittings. Two groups of second cavities 32B are between the third cavities 32C and the two groups of the first cavities 32A and are configured to receive mid-sized female terminal fittings.

A cavity tower 33 is formed in the part of the main body 31 that has the third cavities 32C and a substantially rectangular groove 34 is recessed in the front of the cavity tower 33. The groove 34 separates the third cavities 32C from the second cavities 32B located above and below. Cam pins 35 project from intermediate positions of the left and right surfaces of the cavity tower 33. The cam pins 35 each have a substantially cylindrical shape with a right circular cross section. Unlocking portions 36 project at opposite left and right surfaces of the main body 31 near the rear end of the main body 31 and in positions substantially corresponding to the second cavities 32B.

Figure 1:
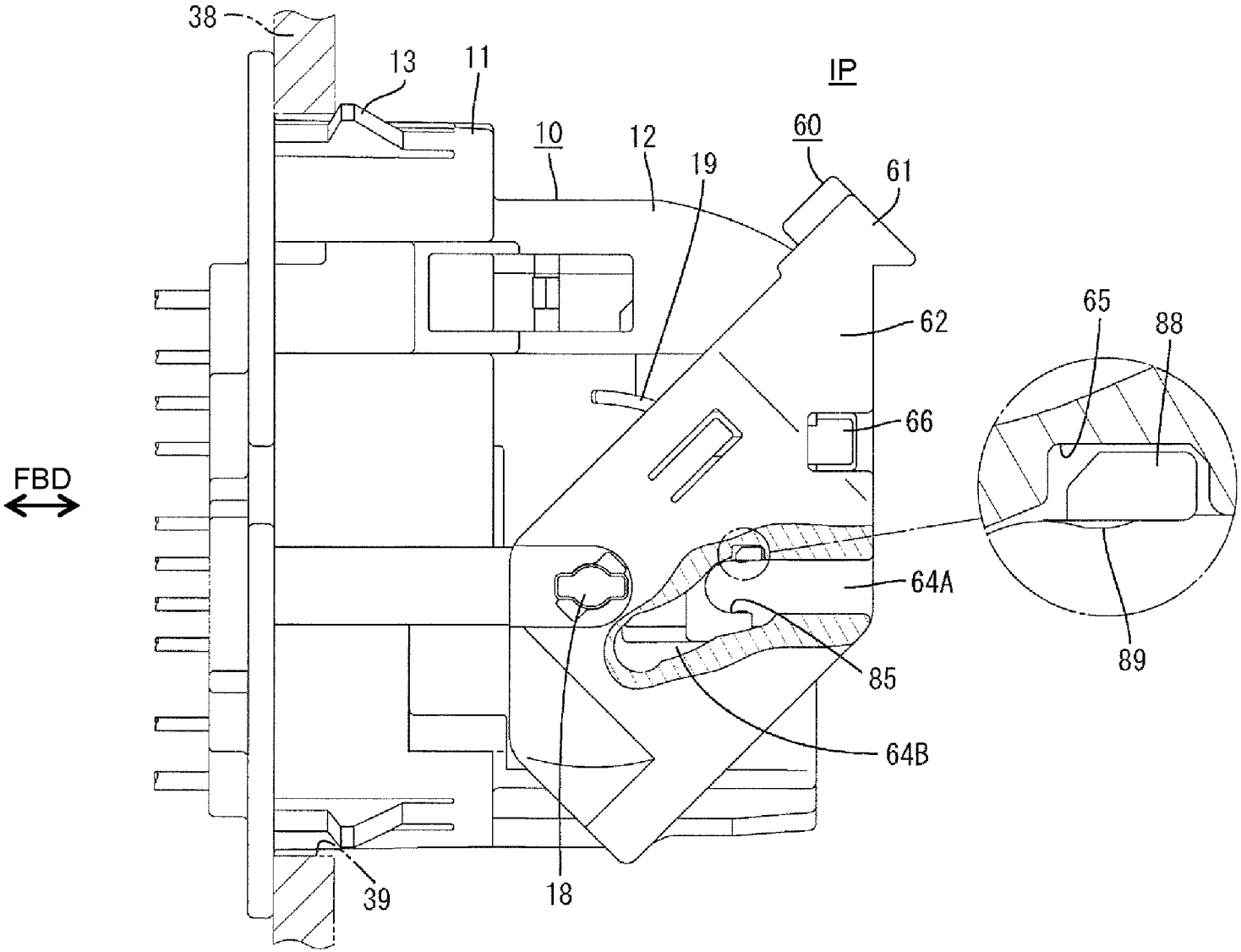
FIG. 1 is a side view showing an essential portion in section in a lever-type connector of a first embodiment when a lever is at an initial position.
Figure 2:
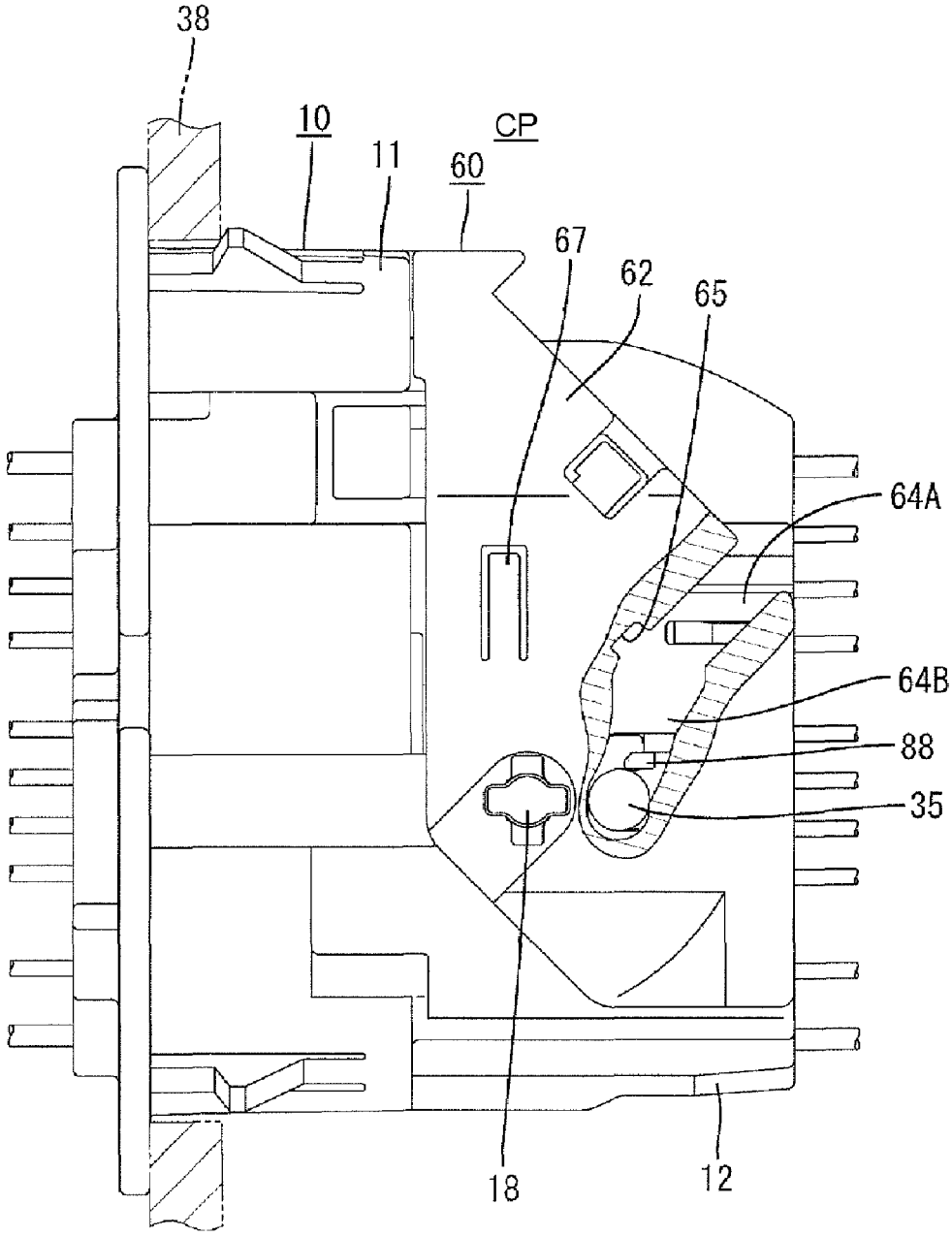
FIG. 2 is a side view showing an essential portion in section when the lever is at a connection position.
Figure 4:
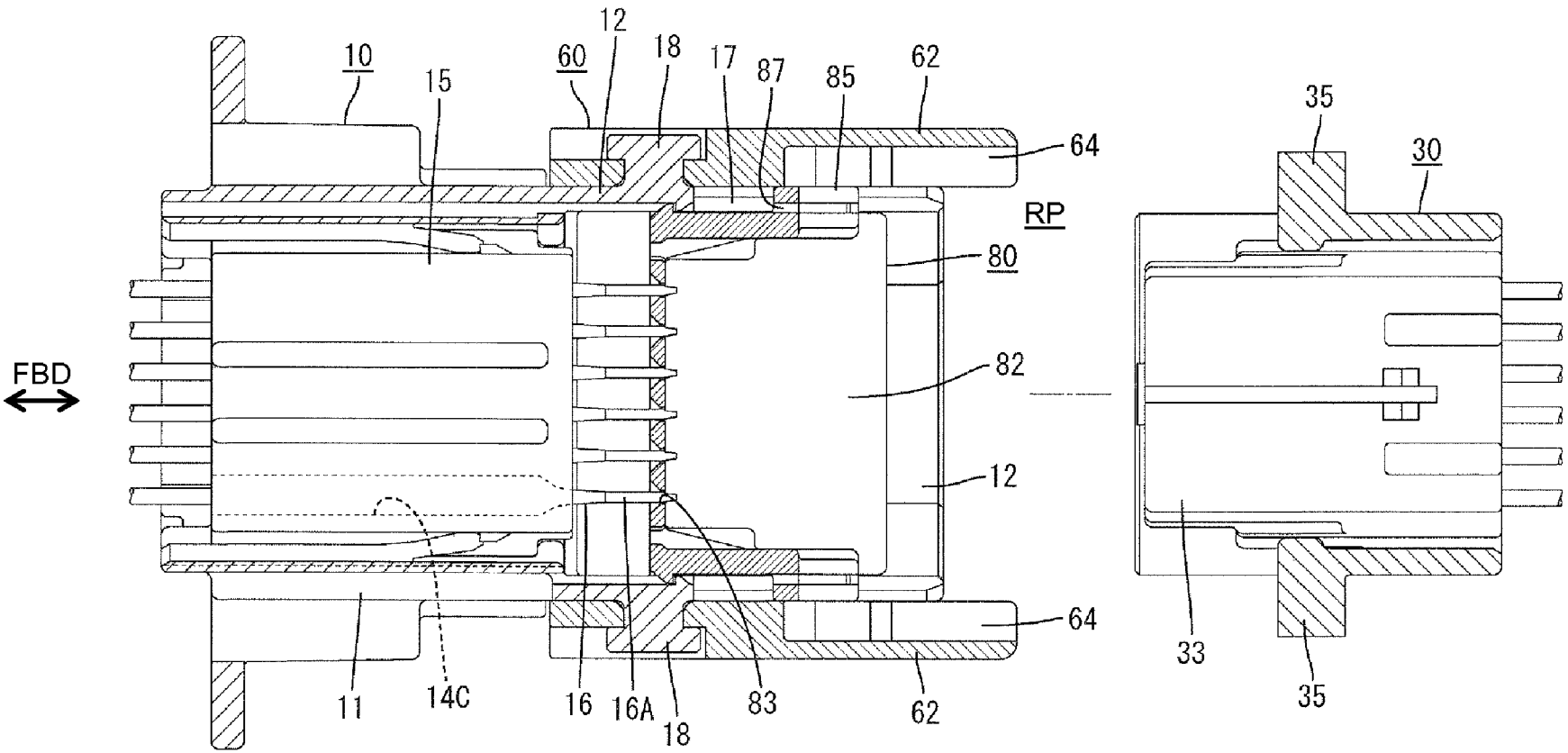
FIG. 4 is a horizontal section before two housings are connected.
Figure 6:
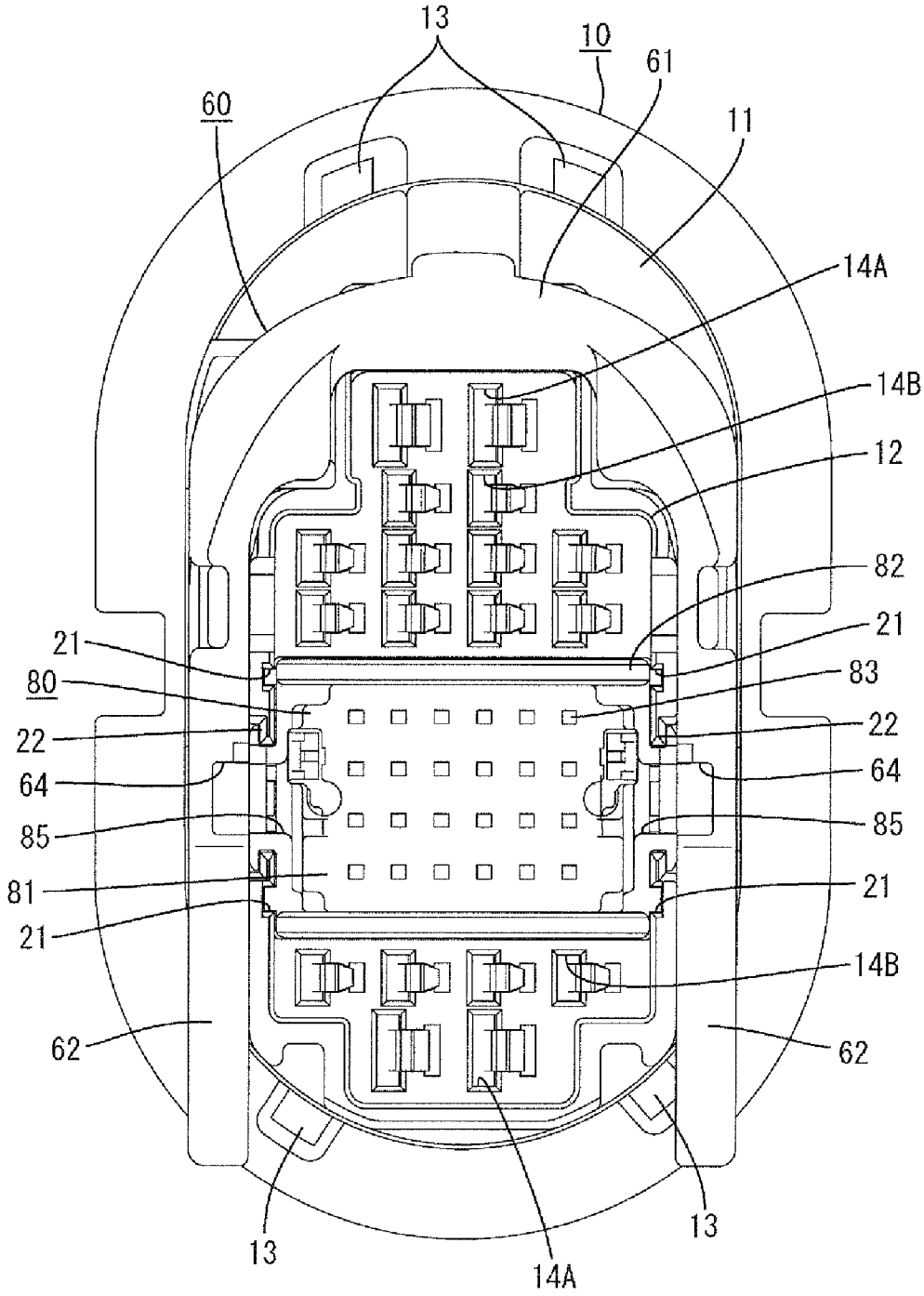
FIG. 6 is a front view of the male housing having the lever and a moving plate assembled therewith.

The male housing 10 is vertically long and includes a terminal accommodating portion 11 and a receptacle 12. The receptacle 12 projects forward from the periphery of the front surface of the terminal accommodating portion 11, as shown in FIGS. 1 and 6. The terminal accommodating portion 11 fits into a mount hole 39 of a panel 38, and includes locking claws 13 engageable with an outer edge of the opening of the mount hole 39. The receptacle 12 is configured to receive the female housing 30. The terminal accommodating portion 11 includes three kinds of cavities 14A, 14B and 14C having different sizes and configurations and disposed at positions substantially corresponding to the cavities 32A, 32B and 32C of the female housing 30. Large male terminal fittings 16 can be inserted into the first cavities 14A, mid-sized terminal fittings 16 can be inserted into the second cavities 14B and small male terminal fittings 16 can be inserted into the third cavities 14C. An auxiliary housing 15 is defined at a part of the terminal accommodating portion 11 corresponding to the third cavities 14C, as shown in FIG. 4, and is separable from a main part of the terminal accommodating portion 11.

Tabs 16A are formed at the leading end of the male terminal fittings 16 and project into the receptacle 12. Cam-pin guiding grooves 17 are formed in the opposite left and right outer surfaces of the receptacle 12 and have open front ends. Supporting shafts 18 project from opposite left and right outer surfaces of the receptacle 12 at positions behind the cam-pin guiding grooves 17 and near the terminal accommodating portion 11.

Figure 10:
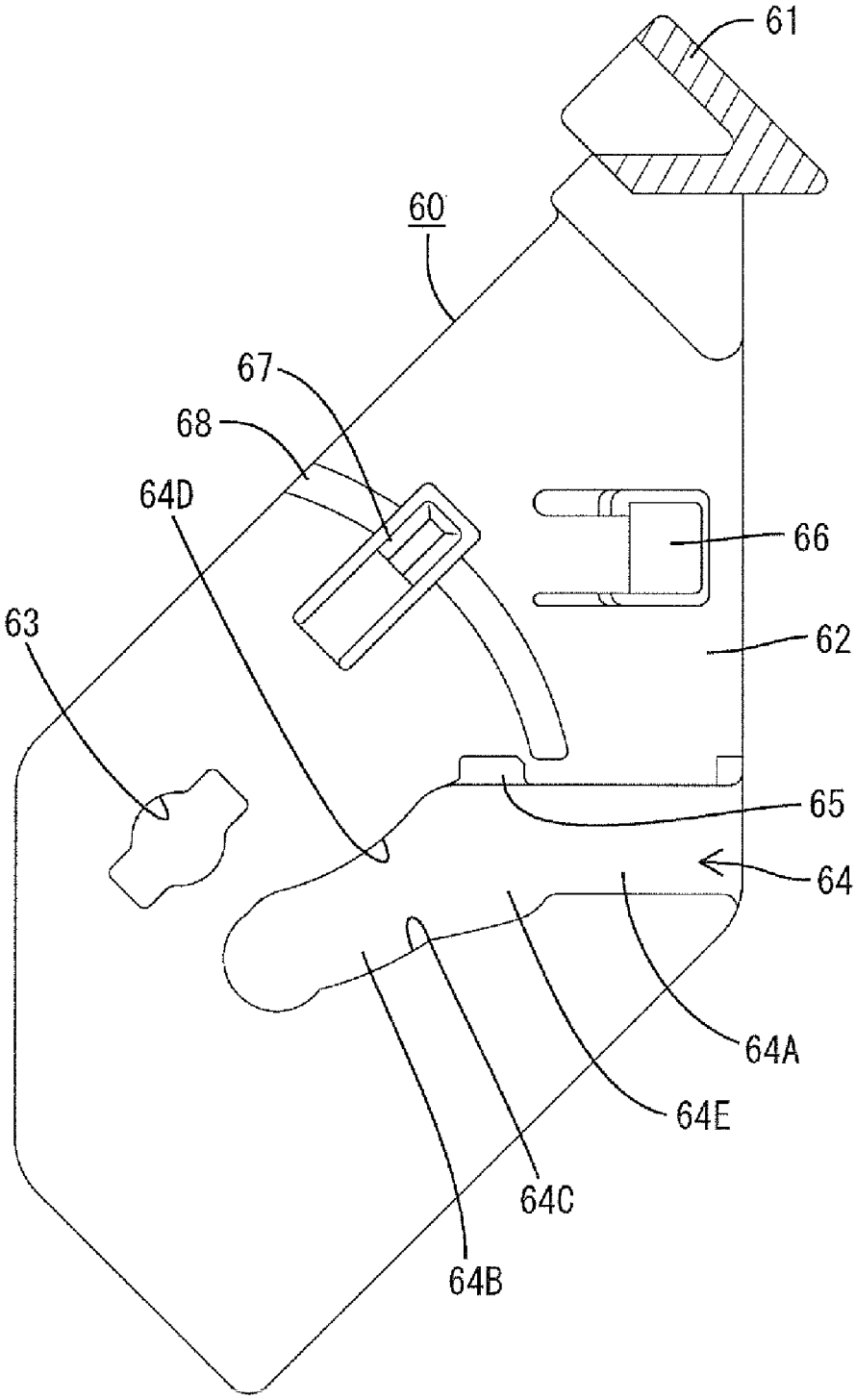
FIG. 10 is a side view in section of the lever.

The connector also includes a lever 60, as shown in FIG. 6. The lever 60 has an operable portion 61 and substantially parallel plate-shaped arms 62 project from opposite ends of the operable portion 61 to define a substantially U-shape. The operable portion 61 extends in the width direction and substantially normal to the forward and backward directions FBD. Shaft holes 63 are formed near the outer peripheral edges of the arms 62, as shown in FIG. 10, and are engageable with the respective supporting shafts 18.

The lever 60 is rotatable about the supporting shafts 18 between an initial position IP where the operable portion 61 is near an opening end of the receptacle 12 and a connection position CP where the operable portion 61 is near a back side of the receptacle 12. The operable portion 61 horizontally crosses above the upper outer surface of the receptacle 12 while the lever 60 is rotated from the initial position IP towards the connection position CP. It should be noted that the initial position IP of the lever 60 is a separation position where the connected state of the two housings 10, 30 is canceled.

Cam grooves 64 are recessed in the inner surfaces of the arms 64. The cam grooves 64 have entrances at the outer peripheral edges of the arms 62, and have back ends near the shaft holes 63. An introducing groove 64A for the cam pin 35 extends substantially straight from the entrance of each cam groove 64 to an intermediate position, and a curved cam-acting groove 64B extends from the intermediate position to the back end of the cam groove 64 for exhibiting a cam action.

The groove surfaces of each cam groove 64 include a connection cam surface 64C to be pressed by and slide in contact with the cam pin 35 as the lever 60 is rotated towards the connection position CP, a separation cam surface 64D to be pressed by and slide in contact with the cam pin 35 as the lever 60 is rotated in a returning direction toward the initial position IP, and a cam bottom surface 64E connecting the back ends of the connection cam surface 64C and the separation cam surface 64D. A substantially rectangular bottomed engaging recess 65 is formed in the inner surface of each arm 62 and opens in the connection cam surface 64C at the back end of the introducing groove 64A immediately before the cam-acting groove 64B.

The arms 62 are formed with resilient partial locking pieces 66 to engage the front edge of the opening of the receptacle 12 when the lever 60 is at the initial position IP. The partial locking pieces 66 hold the lever 60 at the initial position IP. However, the unlocking pieces 36 can deform the partial locking pieces 66 in an unlocking direction so that the lever 60 can rotate towards the connection position CP. The arms 62 also are formed with resilient full locking pieces 67. The full locking pieces 67 engage edges of the locking ribs 19 on the opposite left and right outer surfaces of the receptacle 12 when the lever 60 reaches the connection position CP and keep the lever 60 at the connection position CP. The locking ribs 19 have arcuate shapes extending substantially along a rotational path of the lever 60, and locking grooves 68 are formed in the inner surface of the lever 60 for engaging the locking ribs 19 and guiding the rotation of the lever 60. Claws are at the leading ends of the full locking pieces 67 and are located in the locking grooves 68.

Figure 8:
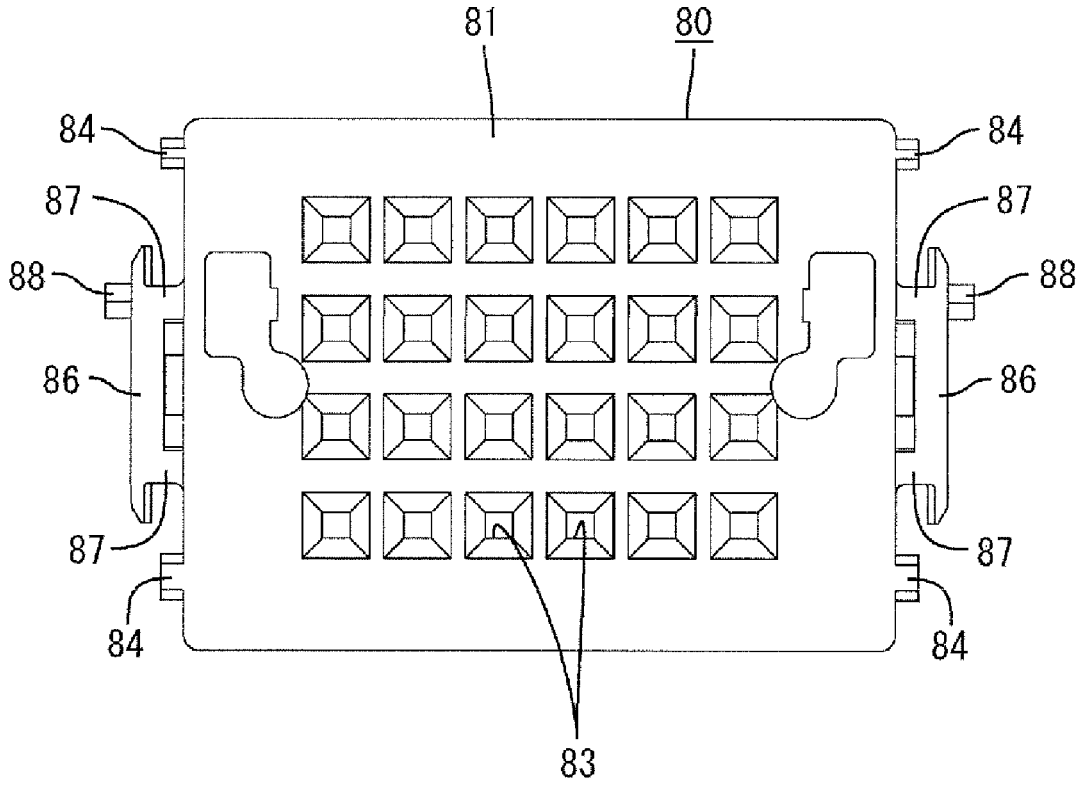
FIG. 8 is a rear view of the moving plate.
Figure 9:
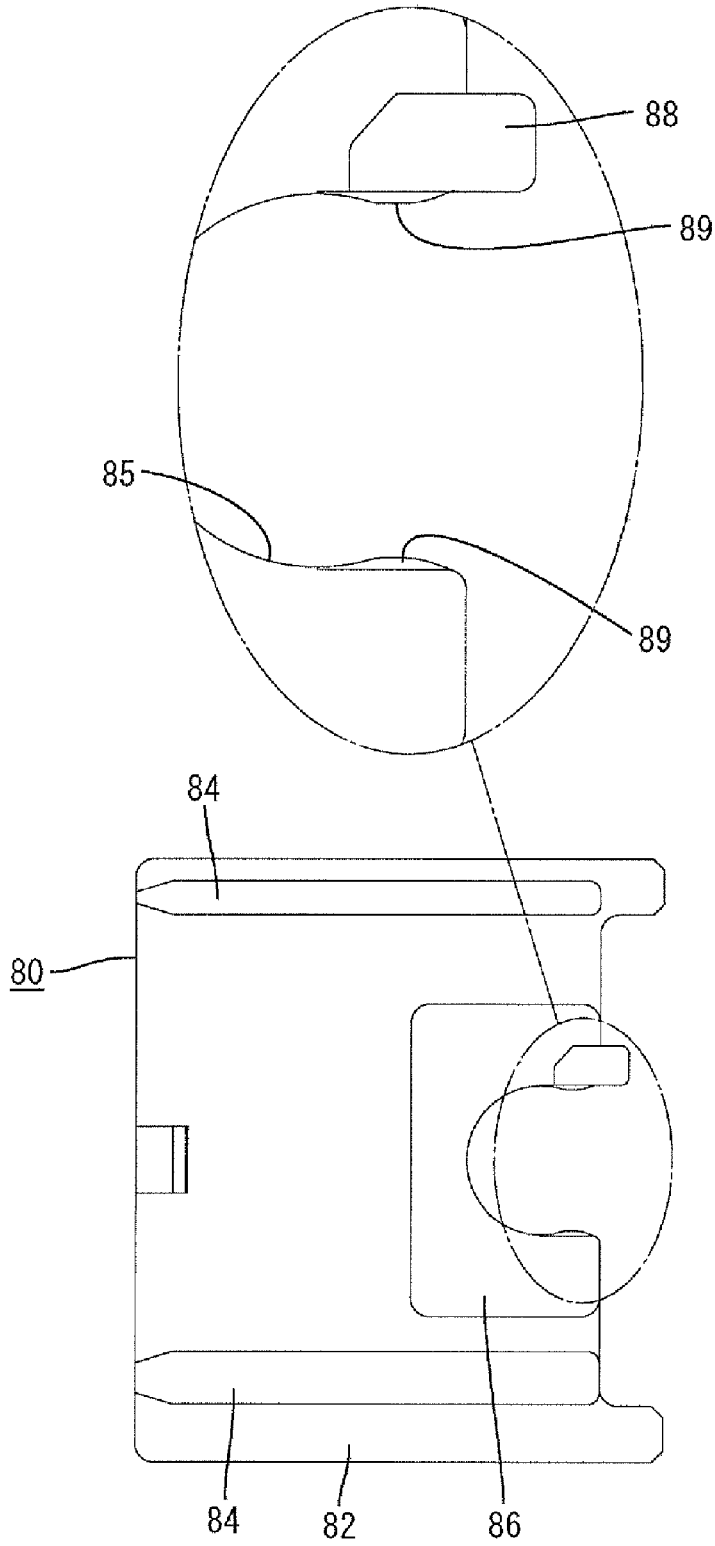
FIG. 9 is a side view of the moving plate.

The connector also includes a moving plate 80. The moving plate 80 is substantially cap-shaped and is formed unitarily with a wide rectangular flat plate main body 81 aligned substantially perpendicular to a projecting direction of the tabs 16A. The moving plate 80 also includes a rectangular tubular surrounding wall 82 that projects forward from the outer periphery of the plate main body 81, as shown in FIGS. 8 and 9. The moving plate 80 is smaller than the opening of the receptacle 12, and is assembled at a position slightly below the vertical center of the receptacle 12 and corresponding to the auxiliary housing 15. The tabs 16A of the middle-size and large-size male terminal fittings 16 are arranged in areas above and below the moving plate 80.

Positioning holes 83 penetrate the plate main body 81 in forward and backward directions FBD. The tabs 16A of the small male terminal fittings 16 are passed through the respective positioning holes 83 and are positioned.

The surrounding wall 82 has horizontal upper and lower walls and substantially vertical left and right side walls. The interior of the receptacle 12 is partitioned into three spaces by the upper and lower walls. The surrounding wall 82 is fit into the recessed groove 34 of the female housing 30 as the lever 60 is mounted. Thus, the moving plate 80 is united with the female housing 30 while having the cavity tower 33 fit at least partly therein.

The moving plate 80 is movable back and forth between a retracted position RP near the opening of the receptacle 12 and an advanced position AP near the back and towards the terminal accommodating portion 11 of the receptacle 12 as the lever 60 is rotated. The leading ends of the tabs 16A project forward from the front surface of the plate main body 81 when the moving plate 80 is at the retracted position RP. However, the rear surface of the plate main body 81 is in contact with the front surface of the terminal accommodating portion 11 at the rear of the receptacle 12 when the moving plate 80 is at the advanced position AP and the tabs 16A can connect with the mating small female terminal fittings to proper depths. Upper and lower guiding ribs 84 are formed on the outer surface of each side wall of the surrounding wall 82 and extend in forward and backward directions FBD. The guiding ribs 84 fit in respective guidable grooves 21 in the opposite inner side surfaces of the receptacle 12 to guide movements of the moving plate 80.

Fitting recesses 85 are formed in the opposite left and right walls of the surrounding wall 82. The fitting recesses 85 are substantially U-shaped and open at the front ends of the side walls. Additionally, the fitting recesses 85 communicate with the respective cam-pin guiding grooves 17 of the receptacle 12 and the respective cam grooves 64 of the lever 60. Two covering plates 86 are mounted on the outer surfaces of the opposite side walls via upper and lower supports 87 and are arranged to cover the outer edges of the openings of the fitting recesses 85 over substantially the entire circumferences. A distance between the outer surfaces of the upper and lower supports 87 is equal to or slightly smaller than the width of the cam-pin guiding grooves 17, and a distance between the inner surfaces of the covering plates 86 and the outer surfaces of the opposite side walls is equal to or slightly larger than the thickness of thinner walls 22 around the cam-pin guiding grooves 17 of the receptacle 17. Accordingly, the moving plate 80 sandwiches the thinner walls 22 of the receptacle 12 between the covering plates 86 and the opposite side walls and is movable while having loose movements restricted during rotation of the lever 60 by sliding contact of the supports 87 with inner side edges of the cam-pin guiding grooves 17. It should be noted that the covering plates 86 do not cover the opposite inner and outer side surfaces of the openings of the fitting recesses 85, so that the openings of the fitting recesses 85 are not blocked off.

Two first engaging portions 88 project at the outer edges of the openings of the fitting recesses 85 of the opposite side walls at positions corresponding to the separation cam surfaces 64D of the cam grooves 64 of the lever 60. The first engaging portions 88 are substantially rectangular plates and are at substantially the same heights as the upper supports 87 in the vertical direction and project sideways a short distance from the outer surfaces of the covering plates 86. The first engaging portions 88 fit into the engaging recesses 65 of the lever 60 when the lever 60 is at the initial position IP to keep the moving plate 80 at the retracted position RP. The first engaging portions 88 normally fit loosely in the cam grooves 64 during rotation of the lever 60. Outer edges of the openings of the fitting recesses 85 including the positions corresponding to the connection cam surfaces 64C of the cam grooves 64 of the lever 60 have no parts, except the first engaging portions 88, insertable into the cam grooves 64, and only the first engaging portions 88 are engageable with the cam grooves 64 in the moving plate 80.

Upper and lower second engaging portions 89 project at the inner edge of the opening of the fitting recess 85 of the side wall at positions near the front end of the side wall. The second engaging portions 89 are raised moderately from the inner peripheral surfaces of the openings of the fitting recesses 85 and are at substantially the same position with respect to forward and backward directions FBD. A distance between the tips of the upper and lower second engaging portions 89 is slightly shorter than the diameter of the cam pins 35. The cam pins 35 move resiliently over and pass beyond the second engaging portions 89 during insertion into the fitting recesses 85. The cam pins 35 could try to come out of the fitting recesses 85 as the lever 60 is rotated towards the initial position IP. However, the cam pins 35 will contact the second engaging portions 89 to be prevented from coming out so that the moving plate 80 moves with the cam pins 35 towards the retracted position.

The connector is assembled by engaging the shaft holes 63 of the lever 60 with the supporting shafts 18 of the male housing 10 to support the lever 60 rotatably on the male housing 10. Further, the guiding ribs 84 of the moving plate 80 are fit into the respective guidable grooves 21 and the covering plates 86 are placed on the outer surfaces of the respective thinner walls 22 of the receptacle 12. Thus, the moving plate 80 is supported movably on the male housing 10. Subsequently, as shown in FIG. 1, the partial locking pieces 66 are caught and engaged with the front edge of the opening of the receptacle 12, thereby keeping the lever 60 at the initial position IP. Additionally, the first engaging portions 88 are fit into the engaging recesses 65 of the lever 60 as the lever 60 is locked partly at the initial position IP. Thus, the moving plate 80 is kept at the retracted position RP. In this state, as shown in FIG. 6, the fitting recesses 85 of the moving plate 80, the cam-pin guiding grooves 17 of the receptacle 12 and the introducing grooves 64A of the cam grooves 64 of the lever 60 communicate with each other while being aligned at substantially the same height with respect to the vertical direction.

The female housing 30 is fit from the front into the male housing 10 having the lever 60 and the moving plate 80 assembled in this way. The leading ends of the cam pins 35 are fit into the introducing grooves 64A of the cam grooves 64 at an initial stage of the connecting operation. Thereafter, the base ends of the cam pins 35 are fit into the fitting recesses 85 and the cam-pin guiding grooves 17. The front surface of the housing main body 31 of the female housing 30 contacts the front surface of the plate main body 81 of the moving plate 80 as the connecting operation proceeds. The unlocking portions 36 then interfere with the partial locking pieces 66 of the lever 60. As a result, the partial locking pieces 66 deform resiliently out in the unlocking direction, to permit the rotation of the lever 60 towards the connection position CP.

The lever 60 is rotated towards the connection position CP in this state. As a result, the engaging recesses 65 are displaced up and are spaced from the first engaging portions 88 and the partial locking of the moving plate 80 at the retracted position RP is canceled. Further, the cam pins 35 are pressed against and slide in contact with the connection cam surfaces 64C of the cam-acting grooves 64B by the rotation of the lever 60. Thus, a cam action is exhibited and the female housing 30 is pulled towards the back of the receptacle 12 with a light operation force. At this time, the cam pins 35 are displaced in the connecting direction along the cam-pin guiding grooves 17 and press the back inner surfaces of the fitting recesses 85 facing in the displacing direction. The moving plate 80 is pressed by the cam pins 35 in this way and is moved from the retracted position RP towards the advanced position AP. During this time, only the cam pins 35 engage with the cam grooves 64 and the first engaging portions 88 are located in the cam grooves 64.

Figure 5:
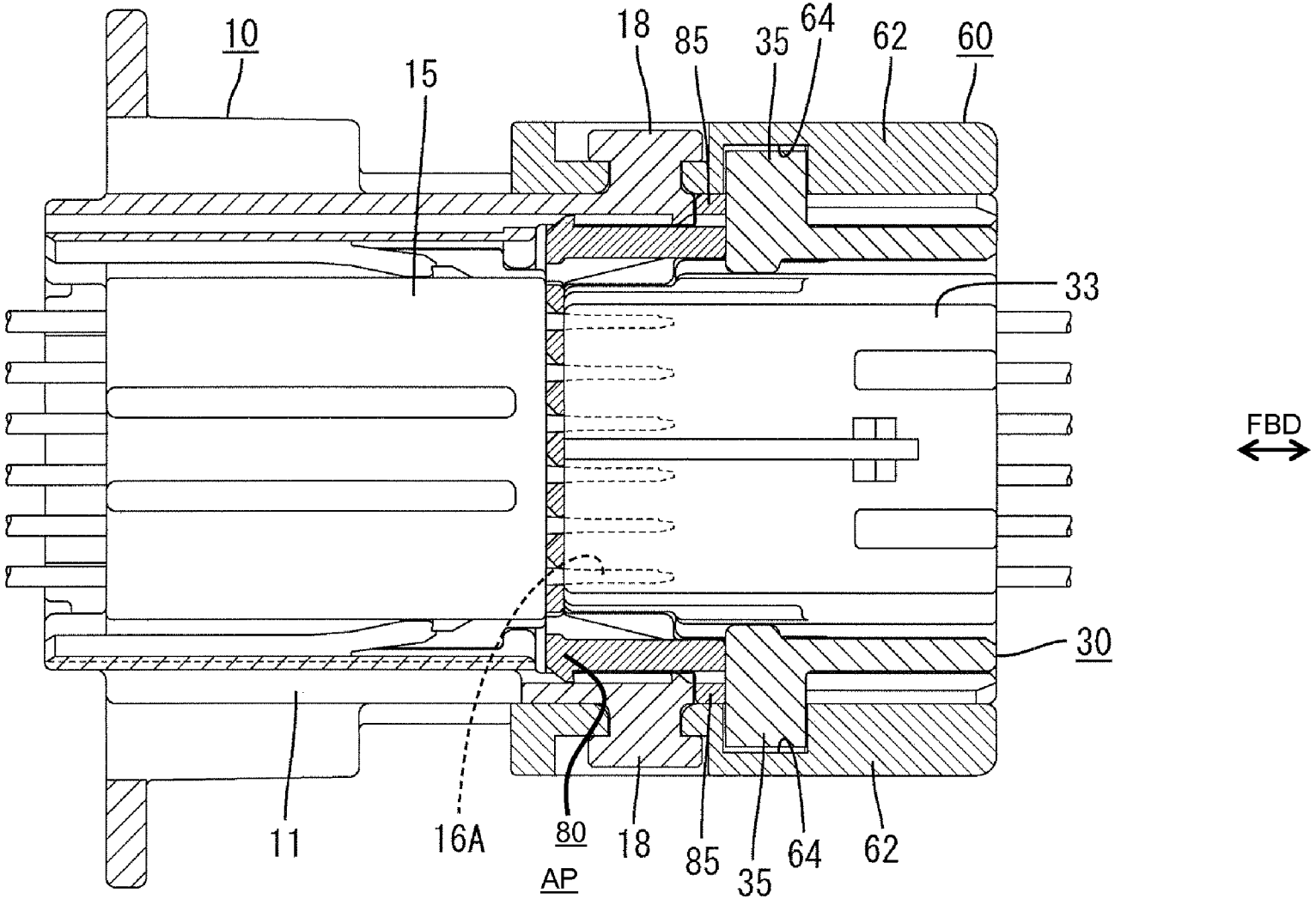
FIG. 5 is a horizontal section after the two connector housings are properly connected.

The full locking pieces 67 catch and engage ends of the locking ribs 19 when the lever 60 reaches the connection position to lock the lever fully at the connection position CP. The moving plate 80 also is kept at the advanced position AP as the lever 60 is locked fully at the connection position CP. If the two housings 10, 30 are connected properly in this way, the male and female terminal fittings are connected electrically to proper depths. At this time, the cam pins 35 are fit closely in the cam grooves 64 as shown in FIG. 5.

Figure 3:
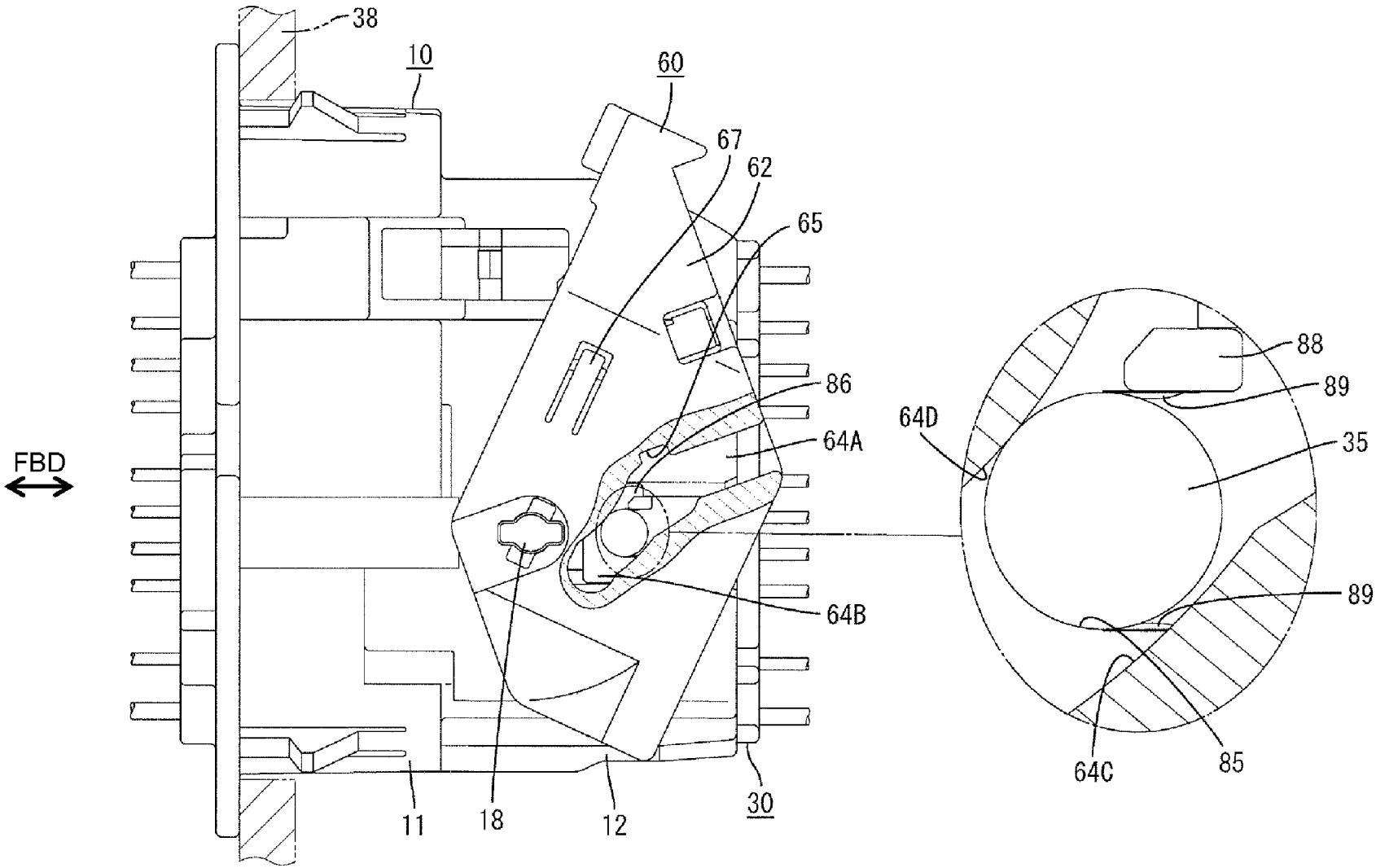
FIG. 3 is a side view showing an essential portion in section in an intermediate state of returning the lever toward the initial position.

To separate the housings 10, 30, the full locking pieces 67 are deformed out in the unlocking direction and the lever 60 is rotated towards the initial position IP. Then, as shown in FIG. 3, the cam pins 35 slide against the separation cam surfaces 64D of the grooves 64B. As a result, the female housing 30 moves back in a direction to come out of the receptacle 12. Further, the cam pins 35 press the second engaging portions 89 in the separating direction so that the moving plate 80 moves to the retracted position RP.

The second engaging portions 89 could be set permanently in fatigue due to repeated use and the like. Thus, the cam pins 35 and the second engaging portions 89 cannot be kept engaged. However, the first engaging portions 88 directly contact the cam pins 35 instead of the second engaging portions 89 while pressing the separation cam surfaces 64D of the cam grooves 64 to prevent the moving plate 80 from being left at an intermediate position during the returning movement to the retracted position. The first engaging portions 88 of the moving plate 80 are fit into the engaging recesses 65 of the lever 60 to hold the moving plate 80 at the retracted position RP again if the lever 60 returns substantially to the initial position IP.

As described above, the moving plate 80 is urged in the connecting direction by the cam pins 35 of the female housing 30 as the lever 60 is rotated towards the connection position CP. Thus, the moving plate 80 can reach the advanced position without any problem. On the other hand, the cam pins 35 are displaced in the direction away from the moving plate 80, as the lever 60 is rotated towards the initial position IP. Thus, the moving plate 80 cannot be kept engaged with the cam pins 35 and cannot automatically return to the retracted position RP without the first and second engaging portions 88, 89.

In the prior art, fitting tubes project at the opposite sides of the outer edges of the openings of the fitting recesses and surround the side surfaces of the cam pins. These fitting tubes would engage the separation cam surfaces of the cam grooves directly or indirectly via the cam pins. Therefore the moving plate can reach the retracted position following a backward displacement of the female housing. However, the cam pins become narrower and weaker since cam follower is formed by uniting the cam pin and the fitting tube. Further, the fitting tubes become larger if an attempt is made to increase the strengths of the cam pins and a demand for the miniaturization of connectors cannot be met.

In contrast to the prior art, the separation cam surfaces 64D of the cam grooves 64 directly engage the first engaging portions 88 or the separation cam surfaces 64D of the cam grooves 64 engage the cam pins 35, which in turn engage the second engaging portions 89. Thus, the moving plate 80 can move to the retracted position RP by rotating the lever 60. In addition, the first and second engaging portions 88, 89 are at outer edges of the openings of the fitting recesses 85 deviated from the sides corresponding to the connection cam surfaces 64C of the cam grooves 64. Accordingly, the diameter of the cam pins 35 is not limited by the presence of the first and second engaging portions 88, 89. In other words, the first engaging portions 88 are provided only at the positions of the outer edges of the openings of the fitting recesses 85 of the moving plate 80 corresponding to the separation cam surfaces 64D of the cam grooves 64, and the second engaging portions 89 are provided at the inner edges of the openings of the fitting recesses 85 of the moving plate 80. These first and second engaging portions 88, 89 are set in a minimum range necessary to move the moving plate 80 to the retracted position RP, and the entire moving plate 80 is not engaged with the connection cam surfaces 64C of the cam grooves 64. Hence, the first and second engaging portions 88, 89 are separated from the cam mechanism for connecting and separating the two housings 10, 30, and only the cam pins 35 function as the cam followers.

In this way, the cam pins 35 can be cylindrical with diameters to extend over the entire widths of the cam grooves 64, and the stability of the cam operation also is guaranteed by increasing areas of engagement of the cam pins 35 and the cam grooves 64.

The moving plate 80 is kept at the retracted position RP while having movements restricted by fitting the first engaging portions 88 into the engaging recesses 65 of the lever 60. The moving plate 80 is moved towards the advanced position AP when the first engaging portions 88 come out of the engaging recesses 65 as the lever 60 is rotated towards the connection side. Thus, it is not necessary to have special positioning portions to keep the moving plate 80 at the retracted position RP in addition to the first engaging portions 88. Therefore the construction of the moving plate 80 can be simplified.

The invention is not limited to the above described and illustrated embodiment. For example, the following embodiments are also embraced by the technical scope of the present invention as defined by the claims.

Only one the first or second engaging portions may be provided.

The first engaging portions may slide in contact with the separation cam surfaces of the cam grooves at the same time the cam pins press the second engaging portions in the separating direction as the lever is rotated toward the separation side.

Special positioning portions for keeping the moving plate at the retracted position may be provided separately from the first engaging portions.

Slits may be formed in the surrounding wall of the moving plate above and below the fitting recesses, the cam pins may interfere with the second engaging portions to widen the fitting recesses toward the slits when the cam pins enter the fitting recesses. In this way, the second engaging portions are prevented from being set permanently in fatigue when the cam pins pass the second engaging portions.

Part of the female housing other than the cam pins may press the moving plate towards the advanced position as the lever is rotated.

The cam grooves may penetrate the arms in the thickness direction.

The moving plate may include a plate main body to cover the entire opening of the receptacle.

The lever and/or the movable plate may in the female connector.

It should be understood that the lever may be displaced along a noncircular path, but may be a slider that moves along a linear path.

What is claimed is:

1. A lever-type connector, comprising:

a lever with at least one cam groove;

a housing including a receptacle supporting the lever displaceably, the housing being connectable with a mating housing of a mating connector; and a moving plate with at least one fitting recess for receiving a cam pin of the second housing, the moving plate being mounted movably back and forth between a retracted position where the moving plate is near an opening end of the receptacle and an advanced position where the moving plate is near a back side of the receptacle while terminal fittings are passed therethrough, wherein:

the cam groove is configured so that the cam pin can slide in contact with a connection cam surface of the cam groove to connect the housing with the mating housing as the lever is displaced towards a connection side, whereas the moving plate is moved to the advanced position by being pressed by the mating housing;

the cam groove further being configured so that the cam pin can slide in contact with a separation cam surface of the cam groove to separate the housing from the mating housing as the lever is displaced towards a separation side; and the moving plate includes at least one engaging portion that projects into the cam groove from a side of an outer edge of the opening of the fitting recess corresponding to the separation cam surface of the cam groove, the engaging portion being disposed and configured to be pressed by and slid along the separation cam surface of the cam groove as the lever is displaced towards the separation side for moving to the retracted position as the lever is displaced toward a separation side, the lever being formed with an engaging recess for engaging the engaging portion when the moving plate is near the retracted position.

2. The lever-type connector of claim 1, wherein the engaging portion is provided at a position of an outer edge of an opening of the fitting recess of the moving plate deviated from a side corresponding to the connection cam surface of the cam groove.

3. The lever-type connector of claim 1, wherein the moving plate is configured to avoid engagement by the connection cam surface of the cam groove.

4. The lever-type connector of claim 1, wherein the engaging portion projects into the fitting recess from an inner edge of an opening of the fitting recess for contact by the cam pin in a separating direction of the mating housing as the lever is displaced towards the separation side.

5. The lever-type connector of claim 1, wherein the engagement of the engaging recess is configured to restrict movement of the moving plate towards the advanced position when the moving plate is at the retracted position, and wherein the engaging recess separates from the engaging portion as the lever is displaced towards the connection side so that the moving plate can move towards the advanced position.

6. The lever-type connector of claim 1, wherein the moving plate comprises at least one guiding rib to be fit into at least one respective guidable groove in the receptacle for guiding movements of the moving plate.

7. The lever-type connector of claim 1, wherein the lever has at least one partial locking piece to engage the receptacle when the lever is at the separation side, at least one full locking piece to engage at least one locking rib provided at the receptacle for positioning the lever at the connection side and wherein the locking rib preferably is engaged with at least one locking groove of the lever for guiding movement of the lever.

8. A lever-type connector assembly comprising:

a housing including a receptacle;

a mating housing configured to fit in the receptacle, the mating housing being formed with at least one cam pin;

a lever displaceably supported on the housing and being formed with at least one cam groove for receiving the cam pin, the cam groove having a connection cam surface for engaging the cam pin and urging the mating housing into the receptacle as the lever is moved in a connection direction and a separation cam surface for engaging the cam pin and urging the mating housing out of the receptacle as the lever is moved in a separation direction, an engaging recess being formed in the separation cam surface; and a moving plate mounted to the housing for movement back and forth between a retracted position where the moving plate is near an opening end of the receptacle and an advanced position where the moving plate is near a back side of the receptacle, the moving plate being formed with at least one fitting recess for receiving the cam pin, at least one engaging portion in proximity to the fitting recess and disposed to be engaged directly by the separation cam surface of the cam groove for urging the moving plate to the retracted position as the lever is displaced in the separation direction, the engaging portion engaging the engaging recess of the lever when the moving plate is near the retracted position for preventing movement of the moving plate to the advanced position, the engaging recess separating from the engaging portion as the lever is moved in the connecting direction.

9. The connector assembly of claim 8, further comprising terminal fittings mounted in the housing and projecting into the receptacle, the moving plate being configured to permit the terminal fittings to pass therethrough as the moving plate is moved to the advanced position.

10. The connector assembly of claim 8, wherein the engaging portion projects into the fitting recess from an inner edge of an opening of the fitting recess for contact by the cam pin in a separating direction of the mating housing as the lever is displaced towards the separation side.

11. A lever-type connector assembly comprising:

a housing including a receptacle;

a mating housing configured to fit in the receptacle, the mating housing being formed with at least one cam pin having a diameter;

a lever displaceably supported on the housing and being formed with at least one cam groove for receiving the cam pin, the cam groove having a connection cam surface for engaging the cam pin and urging the mating housing into the receptacle as the lever is moved in a connection direction and a separation cam surface for engaging the cam pin and urging the mating housing out of the receptacle as the lever is moved in a separation direction; and a moving plate mounted to the housing for movement back and forth between a retracted position where the moving plate is near an opening end of the receptacle and an advanced position where the moving plate is near a back side of the receptacle, the moving plate being formed with at least one fitting recess for receiving the cam pin, at least one engaging portion projecting into the fitting recess so that a width of the fitting recess at the engaging portion is less than the diameter of the cam pin and the engaging portion being disposed to be engaged by the cam pin as the lever is displaced in the separation direction for urging the moving plate to the retracted position.

12. The connector assembly of claim 11, and wherein the moving plate further comprises a direct engaging portion that projects into the cam groove from a side of an outer edge of an opening of the fitting recess corresponding to the separation cam surface of the cam groove and can engage the separation cam surface of the cam groove.

13. The connector assembly of claim 12, wherein the lever is formed with an engaging recess for engaging the direct engaging portion when the moving plate is near the retracted position for preventing movement of the moving plate to the advanced position, the engaging recess separating from the engaging portion as the lever is moved in the connection direction.

* * * * *